US007921506B2

(12) United States Patent
Baek et al.

(10) Patent No.: US 7,921,506 B2
(45) Date of Patent: Apr. 12, 2011

(54) ROBOT CLEANER HAVING FUNCTION FOR DETECTING SEPARATION OF DUST TANK AND CONTROL METHOD THEREOF

(75) Inventors: Oh-Hyun Baek, Incheon (KR); Hyoung-Deuk Im, Seoul (KR)

(73) Assignee: LG Electronics Inc., Seoul (KR)

( * ) Notice: Subject to any disclaimer, the term of this patent is extended or adjusted under 35 U.S.C. 154(b) by 1248 days.

(21) Appl. No.: 11/463,418

(22) Filed: Aug. 9, 2006

(65) Prior Publication Data

US 2007/0039293 A1 Feb. 22, 2007

(30) Foreign Application Priority Data

Aug. 10, 2005 (KR) ..... 10-2005-0073507

(51) Int. Cl.
*A47L 9/00* (2006.01)

(52) U.S. Cl. ..... 15/319; 15/339; 15/352

(58) Field of Classification Search ..... 15/319, 15/339, 352; *A47L 9/00*
See application file for complete search history.

(56) References Cited

U.S. PATENT DOCUMENTS

| | | | | |
|---|---|---|---|---|
| 4,001,912 | A | 1/1977 | Eriksson | 15/339 |
| 4,184,225 | A | 1/1980 | Leinfelt | 15/339 |
| 4,733,430 | A | 3/1988 | Westergren | 15/339 |
| 6,859,975 | B2 * | 3/2005 | Ohta et al. | 15/347 |
| 2004/0199301 | A1 | 10/2004 | Woo et al. | |
| 2004/0210343 | A1 | 10/2004 | Kim et al. | |
| 2008/0047092 | A1 * | 2/2008 | Schnittman et al. | 15/319 |

FOREIGN PATENT DOCUMENTS

| | | | |
|---|---|---|---|
| EP | 0 790 030 | A1 | 8/1997 |
| EP | 0 934 721 | A2 | 8/1999 |
| EP | 1 500 997 | A2 | 1/2005 |
| GB | 2 371 216 | A | 7/2002 |
| GB | 2 377 622 | A | 1/2003 |

* cited by examiner

*Primary Examiner* — David A Redding
(74) *Attorney, Agent, or Firm* — KED & Associates LLP

(57) ABSTRACT

A robot cleaner is provided that includes a body having a receiving portion configured to receive a dust tank mounted thereto, a detector installed at the receiving portion that detects whether the dust tank has been separated from the body by an interaction with the dust tank, and a controller that controls a suction motor installed in the body according to a detection result of the detector. When the dust tank is separated from the receiving portion, the detector detects the separated state of the dust tank immediately and the controller stops the suction motor, thus, preventing dust from being introduced into the body.

11 Claims, 7 Drawing Sheets

ROBOT CLEANER HAVING FUNCTION FOR DETECTING SEPARATION OF DUST TANK AND CONTROL METHOD THEREOF

RELATED APPLICATION

The present disclosure relates to subject matter contained in priority Korean Application No. 10-2005-0073507, filed on Aug. 10, 2005, which is herein expressly incorporated by reference in its entirety.

BACKGROUND OF THE INVENTION

1. Field of the Invention

The present invention relates to a robot cleaner, and more particularly, to a robot cleaner having a function for detecting separation of a dust tank from a body, and operated only when the dust tank is mounted at the body.

2. Description of the Background Art

Generally, a robot cleaner serves to automatically clean an area to be cleaned by moving the area to be cleaned without a user's adjustment, and by sucking foreign materials such as dust, etc. from the floor surface.

The related art robot cleaner will be explained with reference to FIG. 1.

As shown, the related art robot cleaner comprises a suction motor 2 installed in a body 1 for generating a suction force, a dust tank 4 installed at a front side of the suction motor 2, and having a filter 3 for collecting dust, etc. sucked by the suction motor 2; a suction head 6 provided at a lower side of the body 1 so as to be connected to the dust tank 4 by a connection pipe 5, for sucking dust of the floor surface; a controller 7 for controlling an operation of each component; a main brush 8 rotatably installed in the suction head 6 for brushing dust or foreign materials of the floor surface; and a motor (not shown) installed at a peripheral portion of the main brush 8.

In the related art robot cleaner, a user can certify whether the dust tank 4 has been separated from the body 1 by each pressure sensor (not shown) installed at a contact part of 'A' between the connection pipe 5 and the dust tank 4, and a suction side 'B' of the suction motor 2. However, in the related art, the user can certify that the dust tank 4 has been separated from the body 1 by a pressure difference after a cleaning operation is performed.

Accordingly, the related art robot cleaner performs a cleaning even when the dust tank 4 is not coupled to the body 1, and thus dust is accumulated in the body 1 thereby to cause the user's inconvenience.

Moreover, when the dust tank is mounted inside the body, certifying whether the dust tank is mounted at the body is more difficult thus to cause the user's inconvenience.

SUMMARY OF THE INVENTION

Therefore, an object of the present invention is to provide a robot cleaner that is not operated when a dust tank is separated from a body by detecting separation of the dust tank from the body.

Another object of the present invention is to provide a robot cleaner capable of enabling a user to easily certify whether a dust tank is separated from a body by displaying a separated state of the dust tank from the body outside.

To achieve these and other advantages and in accordance with the purpose of the present invention, as embodied and broadly described herein, there is provided a robot cleaner, comprising: a body having a receiving portion for mounting a dust tank; a detecting unit installed at the receiving portion, for detecting whether the dust tank has been separated from the body by an interaction with the dust tank; and a controller for controlling a suction motor installed in the body according to a detection result.

The detecting unit is composed of at least one of a magnetic sensor and an infrared sensor.

A case that the detecting unit is formed of the magnetic sensor will be explained as follows. An inlet connected to a suction motor mounted in the body is formed at the receiving portion, and an outlet contacting the inlet with being coupled to the receiving portion is formed at the dust tank. The magnetic sensor is mounted at a contact portion between the inlet and the outlet.

The dust tank is provided with a magnet portion, and the magnetic sensor immediately detects whether the dust tank has been separated from the body by whether a line of magnetic force generated from the magnet portion exists.

The magnetic sensor can have a rubber characteristic by being formed of a rubber material, thereby sealing a contact portion between the inlet and the outlet.

A case that the detecting unit is formed of the magnetic sensor will be explained as follows. At least one coupling protrusion is provided at the dust tank, and an insertion groove for inserting the coupling protrusion is formed at the receiving portion of the body in correspondence with the coupling protrusion. The infrared sensor is installed at the insertion groove.

The infrared sensor consists of a light emitting portion for emitting infrared rays, and a light receiving portion for receiving infrared rays. Whether the dust tank has been separated from the body is detected by whether the light receiving portion has absorbed infrared rays.

Whether the dust tank has been separated from the body can be immediately detected by the infrared sensor installed at a contact portion between the dust tank and the body.

When it is detected that the dust tank is separated from the body by the detecting unit, the controller stops the suction motor. On the contrary, when it is detected that the dust tank is mounted at the body by the detecting unit, the controller operates the suction motor.

More concretely, the detecting unit immediately detects whether the dust tank has been separated from the body thus to transmit a signal according to the detection result to the controller. Then, when the signal transmitted from the detecting unit shows a separated state of the dust tank from the body, the controller stops the suction motor thereby to prevent the robot cleaner from being operated under a state that the dust tank is separated from the body.

An indicating unit for indicating a separated state of the dust tank from the body can be further provided. The indicating unit can be implemented as at least one of an alarm sound generating unit and a display unit.

A user can certify whether the dust tank has been separated from the body more easily by his ears or eyes through the indicating unit, thereby enhancing a cleaning efficiency.

When the receiving portion is mounted outside the body thus to allow the user directly to mount/separate the dust tank at/from the body, the user can certify a separated state of the dust tank by his naked eyes thereby to have an enhanced convenience.

To achieve these and other advantages and in accordance with the purpose of the present invention, as embodied and broadly described herein, there is also provided a method for controlling a robot cleaner, comprising: detecting whether a dust tank has been separated from a body; and determining whether to operate a suction motor according to the detection result.

The step of detecting is performed by at least one of a magnetic sensor and an infrared sensor.

The step of determining comprises stopping the suction motor when it is detected that the dust tank is separated from the body; and operating the suction motor when it is detected that the dust tank is mounted at the body.

The method for controlling a robot cleaner according to the present invention can further comprise a step of displaying a separated state of the dust tank from the body when it is detected that the dust tank is separated from the body. The step of displaying comprises generating an alarm sound or displaying an image.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a robot cleaner according to a first embodiment of the present invention will be explained.

Figure 1:
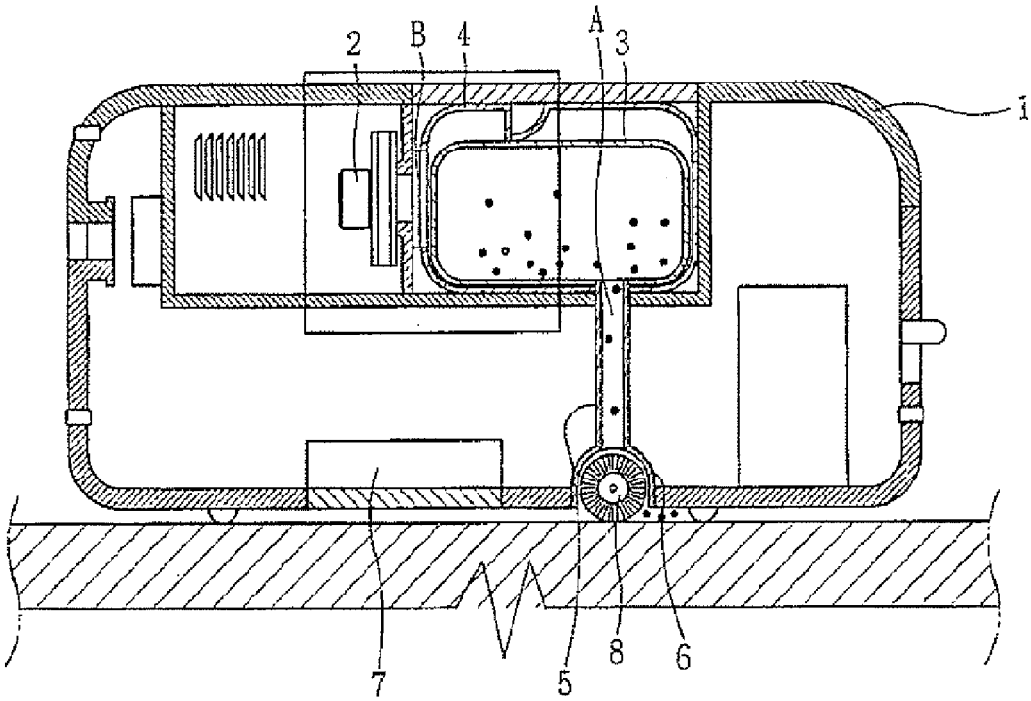
FIG. 1 CONVENTIONAL ART
FIG. 1 is a sectional view showing a robot cleaner in accordance with the related art.
Figure 2:
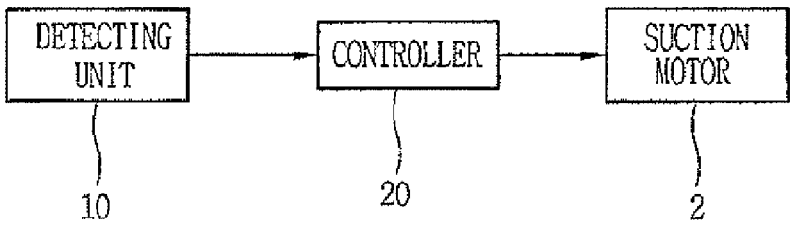
FIG. 2 is a block diagram showing a construction of a robot cleaner according to the present invention.
Figure 3:
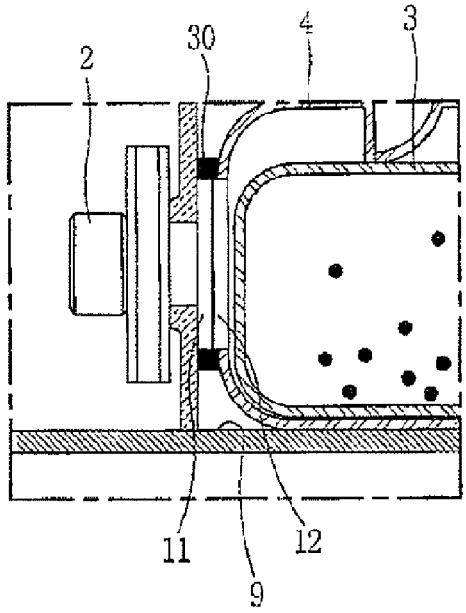
FIG. 3 is an enlarged sectional view showing a robot cleaner according to a first embodiment of the present invention.

FIG. 2 is a block diagram showing a construction of a robot cleaner according to the present invention, and FIG. 3 is an enlarged sectional view showing a robot cleaner according to a first embodiment of the present invention.

As shown, a robot cleaner according to a first embodiment of the present invention comprises: a body 1 having a receiving portion 9 for mounting a dust tank 4; a detecting unit 10 installed at the receiving portion 9, for detecting whether the dust tank 4 has been separated from the body 1 by an interaction with the dust tank 4; and a controller 20 for controlling a suction motor 2 installed in the body 1 according to a detection result.

The detecting unit 10 is implemented as a magnetic sensor for immediately detecting whether the dust tank 4 has been separated from the body 1 by whether a line of magnetic force generated from a magnet portion provided at the dust tank 4 exists.

An inlet 11 connected to the suction motor 2 mounted in the body 1 is formed at the receiving portion 9, and an outlet 12 connected to the inlet 11 under a state that the dust tank 4 is coupled to the receiving portion 9 is formed at the dust tank 4. The magnetic sensor 30 is mounted at a contact portion between the inlet 11 and the outlet 12.

The magnetic sensor 30 can have a rubber characteristic by an interaction with a rubber material, thereby sealing a contact portion between the inlet 11 and the outlet 12. As the magnetic sensor 30 performs a sealing function, a suction force of the suction motor 2 is increased and a cleaning efficiency is enhanced.

Figure 4:
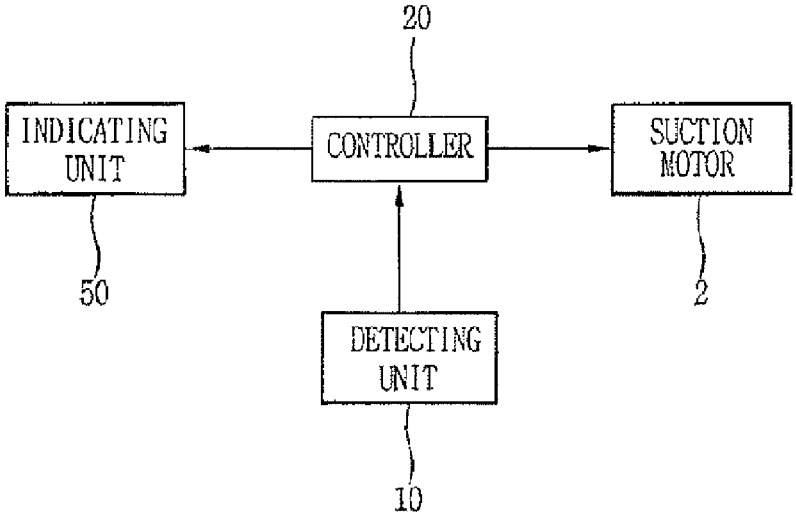
FIG. 4 is a block diagram showing the robot cleaner having an indicating unit according to the present invention.

As shown in FIG. 4, the robot cleaner according to the first embodiment of the present invention can further comprise an indicating unit 50 for indicating a separated state of the dust tank 4 from the receiving portion 9 when it is detected that the dust tank 4 is separated from the receiving portion 9.

The indicating unit 50 can be implemented as at least one of an alarm sound generating unit and a display unit, respectively showing a separated state of the dust tank 4 from the receiving portion 9 by sound and by an image to a user. The user can more easily certify whether the dust tank 4 has been separated from the receiving portion 9 through the indicating unit 50.

An operation and an effect of the robot cleaner according to the first embodiment of the present invention will be explained.

When a cleaning command is generated from the user, the magnetic sensor 30 detects whether the dust tank 4 has been separated from the receiving portion 9 by whether a line of magnetic force generated from a magnet portion (not shown) provided at the dust tank 4 exists.

When it is detected that the dust tank 4 is mounted at the receiving portion 9, the magnetic sensor 30 transmits a signal informing the mounted state to the controller 20. Then, the controller 20 operates the suction motor 2 thus to start a cleaning operation.

On the contrary, when it is detected that the dust tank 4 is separated from the receiving portion 9, the magnetic sensor 30 transmits a signal informing the separated state to the controller 20. Then, the controller 20 maintains a stopped state of the suction motor 2 and transmits a signal to the indicating unit 50, thereby informing the user that the dust tank 3 has been separated from the body 1 by alarming sound or an image on a screen, etc.

The magnetic sensor 30 continuously performs the detecting operation during the cleaning operation.

When the dust tank 4 is separated from the receiving portion 9 accordingly as the robot cleaner collides with an obstacle, etc., the magnetic sensor 30 detects the separated state of the dust tank 4 thus to transmit a signal to the controller 20. Then, the controller 20 stops the suction motor 2 and transmits a signal to the indicating unit 50 thus to inform the user that the dust tank 4 has been separated from the receiving portion 9.

In the robot cleaner according to the present invention, the magnetic sensor 30 is installed at the receiving portion 9 thus to immediately detect whether the dust tank 4 has been separated from the receiving portion 9.

When it is detected that the dust tank 4 has been separated from the receiving portion 9, the suction motor 2 is stopped by the controller 20 thus to prevent dust from being introduced into the body.

When it is detected that the dust tank 4 is separated from the receiving portion 9, the indicating unit 50 indicates the separated state of the dust tank 4 so as to inform the user.

Hereinafter, a robot cleaner according to the second embodiment of the present invention will be explained with reference to FIGS. 5A and 5B. The same reference numerals will be given to the same parts of the second embodiment as those of the first embodiment.

As shown, the detecting unit 10 of the robot cleaner according to the second embodiment of the present invention consists of an infrared sensor 40 having a light emitting portion 41 for emitting infrared rays, and a light receiving portion 42 for receiving infrared rays. Whether the dust tank 4 has been separated from the receiving portion 9 is detected by whether the light receiving portion 42 has absorbed infrared rays.

At least one coupling protrusion 13 is protruding from a lower surface of the dust tank 4, and an insertion groove 14 for inserting the coupling protrusion 13 is formed at the receiving portion 9 of the body 1 in correspondence with the coupling protrusion 13. The infrared sensor 40 is installed in the insertion groove 14.

Figure 5A:
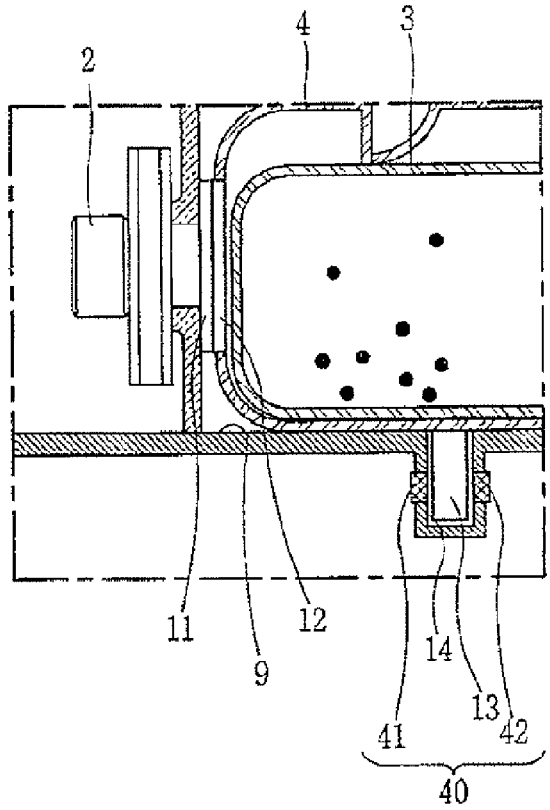
FIGS. 5A to 5D are enlarged sectional view showing a robot cleaner according to a second embodiment of the present invention.

FIG. 5A shows a state that the light emitting portion 41 and the light receiving portion 42 of the infrared sensor 40 are mounted to face each other with the coupling protrusion 13 being interposed therebetween.

Figure 5B:
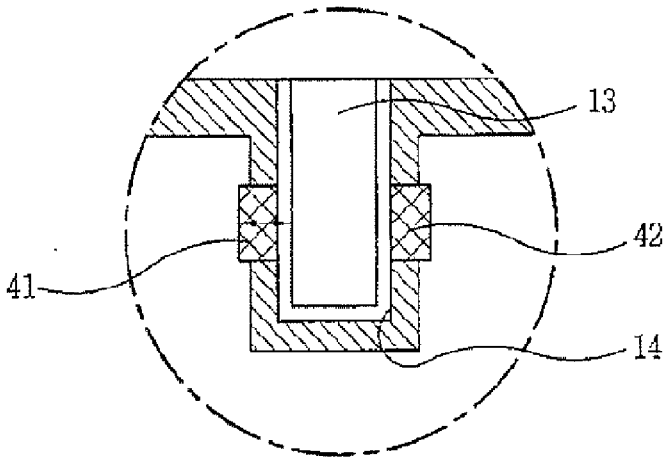

When the coupling protrusion 13 is inserted into the insertion groove 14, that is, when the dust tank 4 is mounted at the receiving portion 9, infrared rays emitted from the light emitting portion 41 are reflected by the coupling protrusion 13 thus net to be introduced into the light receiving portion 42, as shown in FIG. 5B. Herein, the controller 20 judges that the dust tank 4 has been mounted at the receiving portion 9, thereby operating the suction motor 2.

Figure 5C:
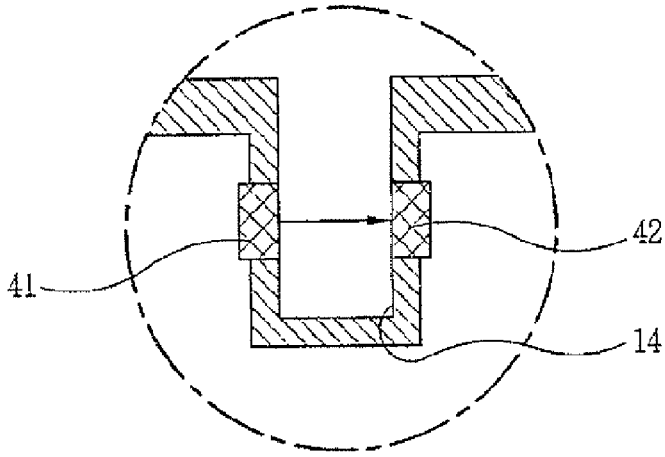

On the contrary, when the coupling protrusion 13 is not inserted into the insertion groove 14, that is, the dust tank 4 is separated from the receiving portion 9, infrared rays emitted from the light emitting portion 41 are introduced into the light receiving portion 42, as shown in FIG. 5C. Herein, the controller 20 judges that the dust tank 4 has been separated from the receiving portion 9, thereby stopping the suction motor 2.

Figure 5D:
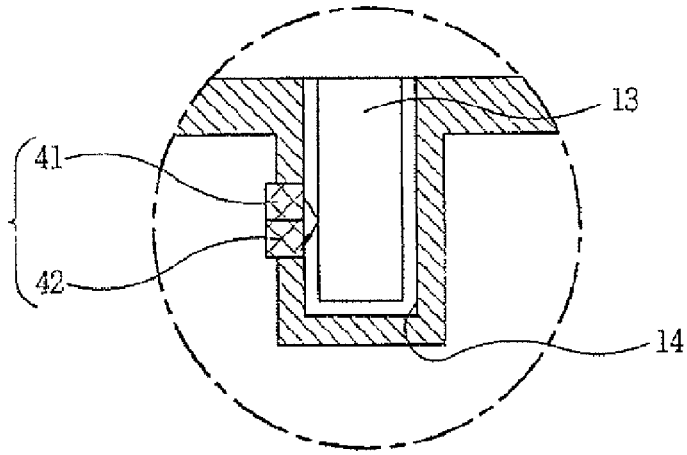

FIG. 5D shows that the tight emitting portion 41 and the light receiving portion 42 of the infrared sensor 40 are integrally formed to be installed at an inner side of the insertion groove 14.

When the coupling protrusion 13 is inserted into the insertion groove 14, that is, when the dust tank 4 is mounted at the receiving portion 9, infrared rays emitted from the light emitting portion 41 are reflected by the coupling protrusion 13 thus to be introduced into the light receiving portion 42 in an opposite manner to that of FIG. 5A. Herein, the controller 20 judges that the dust tank 4 has been mounted at the receiving portion 9, thereby operating the suction motor 2.

On the contrary, when the coupling protrusion 13 is not inserted into the insertion groove 14, that is, the dust tank 4 is separated from the receiving portion 9, infrared rays emitted from the light emitting portion 41 are not introduced into the light receiving portion 42. Herein, the controller 20 judges that the dust tank 4 has been separated from the receiving portion 9, thereby stopping the suction motor 2.

Like the robot cleaner according to the first embodiment, the robot cleaner according to the second embodiment of the present invention can further comprise an indicating unit 50 for indicating a separated state of the dust tank 4 from the receiving portion 9 when it is detected that the dust tank 4 is separated from the receiving portion 9.

An operation and an effect of the robot cleaner according to the second embodiment of the present invention are the same as those of the robot cleaner according to the first embodiment except for the infrared sensor 40, and their explanation will be omitted.

Figure 6:
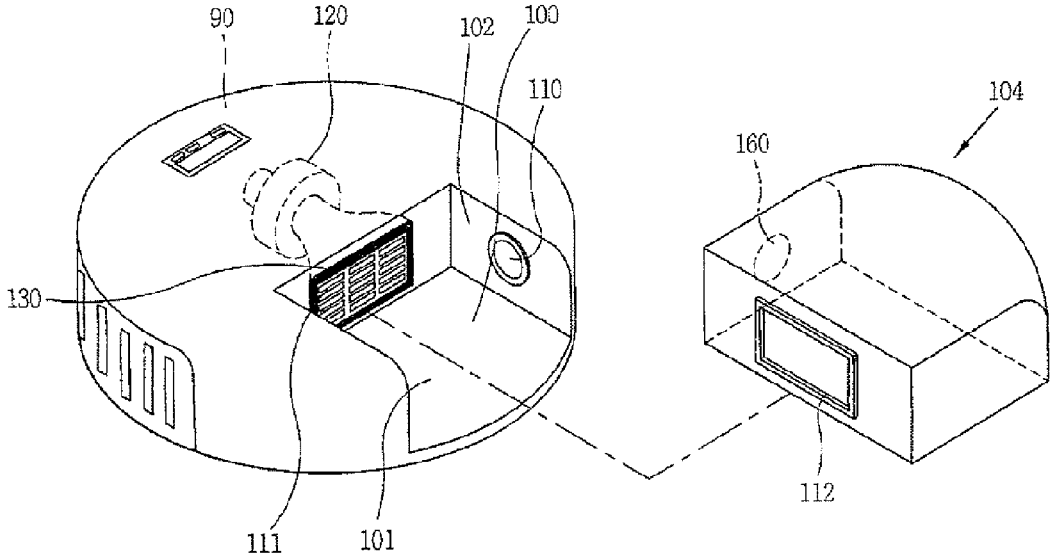
FIG. 6 is a disassembled perspective view showing a robot cleaner according to a third embodiment of the present invention.
Figure 7:
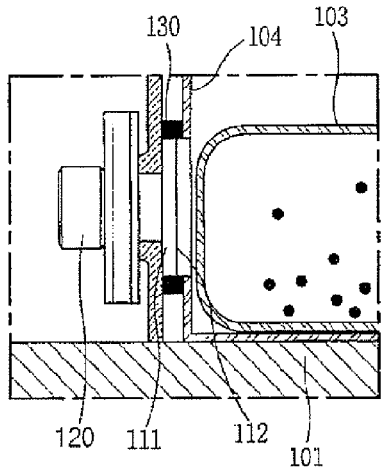
FIG. 7 is an enlarged sectional view of the robot cleaner according to a third embodiment of the present invention.

A robot cleaner according to a third embodiment of the present invention will be explained with reference to FIGS. 6 and 7. The same reference numerals will be given to the same parts of the first embodiment as those of the first embodiment.

The robot cleaner according to the third embodiment of the present invention comprises a body 90; a dust tank 104 coupled to a receiving portion 100 concaved outside the body 90; and a detecting unit 10 installed at the receiving portion 100 for detecting whether the dust tank 104 has been separated from the receiving portion 100 by an interaction with the dust tank 104.

The robot cleaner according to the third embodiment of the present invention is different from the robot cleaners according to the first embodiment and the second embodiment in that the dust tank 104 is installed outside the body 90.

The receiving portion 100 consists of a horizontal contact portion 101 contacting a lower surface of the dust tank 104 under a state that the dust tank 104 is coupled to the receiving portion 100; and a vertical contact portion 102 arranged to be perpendicular to the horizontal contact portion 101, and contacting both side surfaces and a front surface of the dust tank 104 under a state that the dust tank 104 is coupled to the receiving portion 100.

A through hole 160 connected to a connection pipe 110 for guiding dust introduced into the body 90 to the dust tank 104 is formed at a side surface of the dust tank 104, and a filter 103 for collecting collected dust is provided in the dust tank 104.

An outlet 112 is formed at a front surface of the dust tank 104, and an inlet 111 connected to a suction motor 120 is formed at the vertical contact portion 102 of the receiving portion 100 corresponding to the front surface of the dust tank 104. The outlet 112 and the inlet 111 come in contact with each other under a state that the receiving portion 100 is mounted at the dust tank 104.

The detecting unit 10 for detecting whether the dust tank 104 has been separated from the receiving portion 100 by interacting with the dust tank 104 is installed at the receiving portion 100 of the body 90.

The detecting unit 10 is a magnetic sensor 130 for detecting whether the dust tank 104 has been separated from the receiving portion 100 body by whether a line of magnetic force generated from a magnet portion (not shown) provided at the dust tank 104 exists.

The magnetic sensor 130 is installed at a contact portion between the outlet 112 and the inlet 111. Like the magnetic sensor 130 of the first embodiment, the magnetic sensor 130 of the second embodiment can seal the contact portion between the inlet 111 and the outlet 112 by being formed of a rubber material.

An indicating unit 50 for indicating a separated state of the dust tank 104 from the receiving portion can be further provided like in the first and second embodiments.

An operation and an effect of the robot cleaner according to the third embodiment of the present invention are the same as those of the first embodiment, and thus their explanation will be omitted.

A robot cleaner according to a fourth embodiment of the present invention will be explained with reference to FIG. 8. The same reference numerals are given to the same parts as these of the third embodiment.

As shown, a detecting unit 10 of the robot cleaner according to the fourth embodiment of the present consists of an infrared sensor 140 having a light emitting portion 141 for emitting infrared rays, and a light receiving portion 142 for receiving infrared rays. Whether a dust tank 104 has been separated from a receiving portion 100 is detected by whether the light receiving portion 142 has absorbed infrared rays.

At least one coupling protrusion 113 is protruding from a lower surface of the dust tank 104, and an insertion groove 114 for inserting the coupling protrusion 113 is formed at a horizontal contact portion 101 of the receiving portion 100 in correspondence with the coupling protrusion 113. The infrared sensor 140 is installed in the insertion groove 114.

Figure 8:
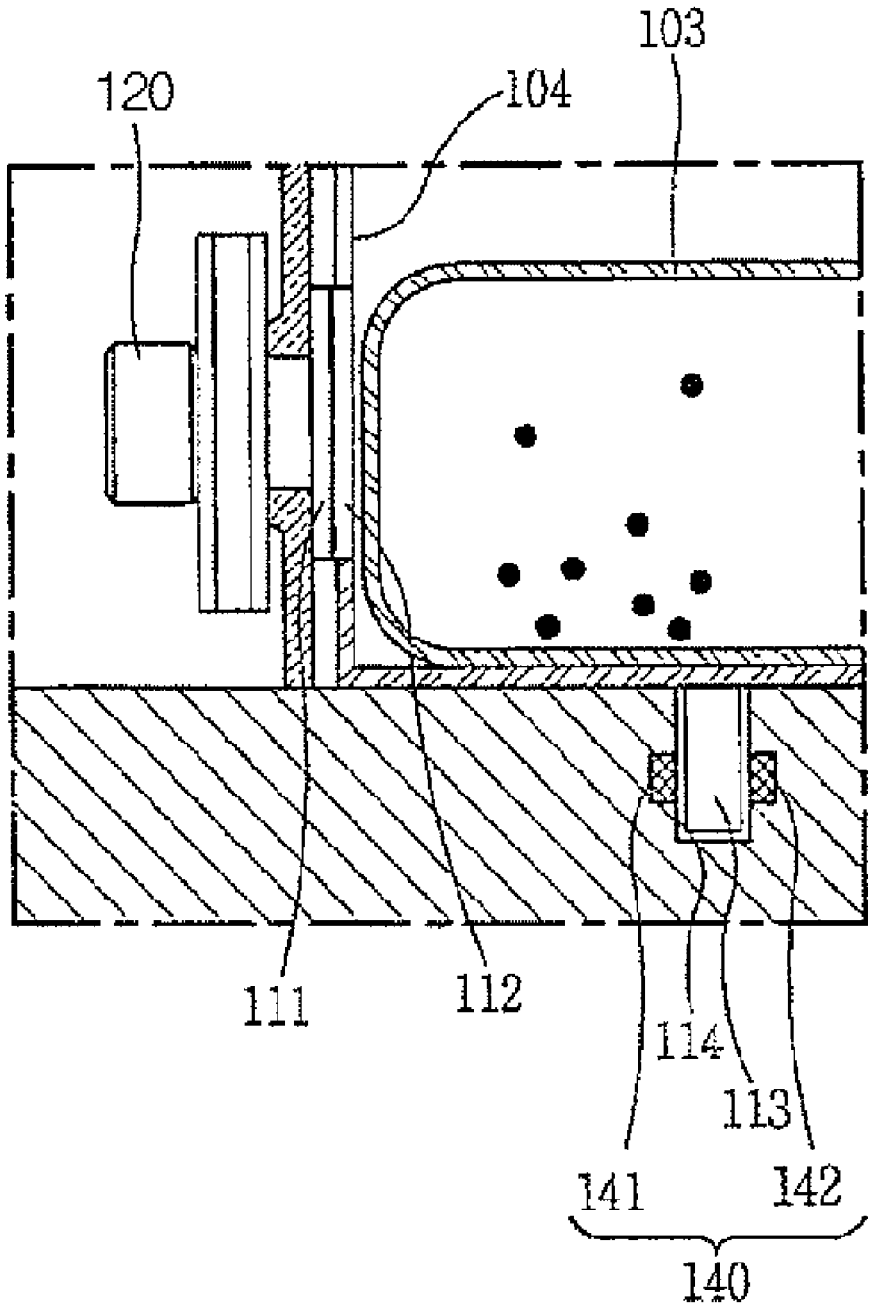
FIG. 8 is an enlarged sectional view of a robot cleaner according to a fourth embodiment of the present invention.

FIG. 8 shows a state that the light emitting portion 141 and the light receiving portion 142 of the infrared sensor 140 are mounted to face each other with the coupling portion 113 being interposed therebetween. However, it is also possible that the light emitting portion 141 and the light receiving portion 142 of the infrared sensor 140 are integrally formed to be installed at an inner side of the insertion groove 114 like in the second embodiment.

An indicating unit 50 for indicating a separated state of the dust tank 104 from the receiving portion 100 when it is detected that the dust tank 104 is separated form the receiving portion by the infrared sensor 140 can be further provided like in the first to third embodiments.

An operation and an effect of the robot cleaner according to the fourth embodiment of the present invention are the same as those of the second embodiment, and thus their explanation will be omitted.

In the first to fourth embodiments of the present invention, either a magnetic sensor or an infrared sensor is installed as the detecting unit. However, both the magnetic sensor and the infrared sensor can be installed so as to detect whether the dust tank is separated from the receiving portion.

The position of the magnetic sensor or the infrared sensor can be variously implemented inside the receiving portion without being limited to the first to fourth embodiments.

Hereinafter, a method for controlling a robot cleaner according to the present invention will be explained.

The method for controlling a robot cleaner comprises: detecting whether a dust tank has been separated from a body (S1); and determining whether to operate a suction motor according to the detection result (S2, S3, and S4).

The step of detecting (S1) is performed by a detecting unit 10 mounted at a receiving portion of the body, that is, at least one of a magnetic sensor and an infrared sensor. Whether the dust tank has been separated from the receiving portion is detected by an interaction between the detecting unit 10 and the dust tank.

The steps of determining (S2, S3, and S4) comprise stopping the suction motor when it is detected that the dust tank is separated from the body (S2, S3), and operating the suction motor when it is detected that the dust tank is mounted at the body (S2, S4).

The method for controlling a robot cleaner can further comprise displaying a separated state of the dust tank from the body when it is detected that the dust tank is separated from the body (S5). A user can more easily certify whether the dust tank has been separated from the body through the step of displaying.

An operation and an effect of the method for controlling a robot cleaner will be explained.

Figure 9:
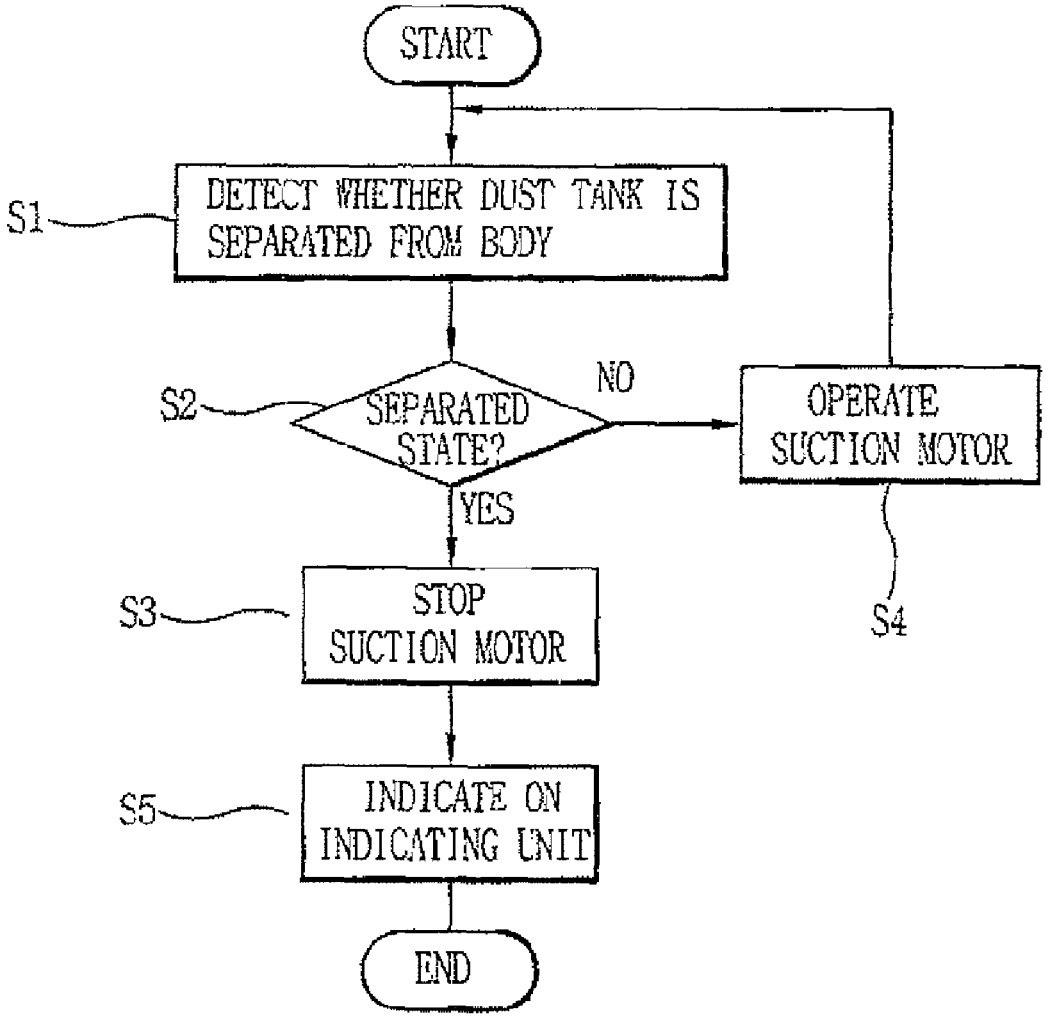
FIG. 9 is a flowchart showing a method for controlling a robot cleaner according to the present invention.

As shown in FIG. 9, when a cleaning command is generated from the user, the detecting unit 10 detects whether the dust tank has been separated from the receiving portion by an interaction with the dust tank.

When it is detected that the dust container is mounted at the receiving portion, the detecting unit 10 transmits a signal informing the mounted state to the controller 20. Then, the controller 20 operates the suction motor thus to start a cleaning operation.

On the contrary, when it is detected that the dust container is separated from the receiving portion the detecting unit 10 transmits a signal informing the separated state to the controller 20. Then, the controller 20 stops the suction motor and transmits a signal to the indicating unit 50, thereby informing the user that the dust tank 3 has been separated from the body by an alarming sound or an image on a screen, etc.

The detecting unit 10 is continuously performed during the cleaning operation.

When the dust tank is separated from the receiving portion accordingly as the robot cleaner collides with an obstacle, etc., the detecting unit 10 detects the separated state of the dust tank thus to transmit a signal to the controller 20. Then, the controller 20 stops the suction motor 2 and transmits a signal to the indicating unit 50 thus to inform the user that the dust tank has been separated from the receiving portion.

In the method for controlling a robot cleaner according to the present invention, when the dust tank is separated from the body, the detecting unit immediately detects the separated state of the dust tank thus to stop the suction motor. Accordingly, dust is prevented from being introduced into the body.

Furthermore, since the method further comprises the step for displaying a separated state of the dust tank from the body, the user can more easily certify whether the dust tank is separated from the body thus to fast perform a proper step.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A robot cleaner, comprising:

a body having a receiving portion configured to receive a dust tank mounted thereto;

a detector installed at the receiving portion, that detects whether the dust tank has been separated from the body by an interaction with the dust tank; and a controller that controls a suction motor installed in the body according to a detection result, wherein the detector comprises an infrared sensor, wherein at least one coupling protrusion is provided at the dust tank, wherein at least one insertion groove configured to receive inserted therein the at least one coupling protrusion is formed at the receiving portion of the body in correspondence with the at least one coupling protrusion, and wherein the infrared sensor is installed at the at least one insertion groove.

2. The robot cleaner of claim 1, wherein the infrared sensor comprises a light emitting portion that emits infrared rays and a light receiving portion configured to receive infrared rays, and wherein the light emitting portion and the light receiving portion are arranged to face each other in the at least one insertion groove.

3. The robot cleaner of claim 1, wherein the infrared sensor comprises a light emitting portion that emits infrared rays and a light receiving portion configured to receive infrared rays, and wherein the light emitting portion and the light receiving portion are integrally formed.

4. The robot cleaner of claim 1, wherein the controller stops the suction motor when it is detected that the dust tank is separated from the receiving portion by the detector, and operates the suction motor when it is detected that the dust tank is mounted at the receiving portion by the detector.

5. The robot cleaner of claim 1, wherein the receiving portion is formed outside the body, and the dust tank is detachably coupled to the receiving portion.

6. The robot cleaner of claim 1, further comprising an indicating device that indicates a separated state of the dust tank from the receiving portion when it is detected that the dust tank is separated from the receiving portion by the detector.

7. The robot cleaner of claim 6, wherein the indicating device is comprises at least one of an alarm sound generating device or a display.

8. A method for controlling a robot cleaner, the method comprising:

detecting whether a dust tank has been separated from a body; and determining whether to operate a suction motor according to the detection result, wherein the detecting is performed by an infrared sensor installed at least one insertion groove formed at a receiving portion of the body and configured to receive inserted therein at least one coupling protrusion formed at the dust tank.

9. The method of claim 8, wherein the determining comprises:

stopping the suction motor when it is detected that the dust tank is separated from the body; and operating the suction motor when it is detected that the dust tank is mounted at the body.

10. The method of claim 8, further comprising:

displaying a separated state of the dust tank from the body when it is detected that the dust tank is separated from the body.

11. The method of claim 10, wherein the displaying comprises generating an alarm sound or displaying an image.

* * * * *